US009586738B2

(12) United States Patent
Herrbach et al.

(10) Patent No.: US 9,586,738 B2
(45) Date of Patent: Mar. 7, 2017

(54) CHILD SAFETY CLOSING DEVICE WITH FIRST OPENING INDICATOR SCREW AND RING

(75) Inventors: Bruno Herrbach, Morsang sur orge (FR); Bruno Guillon, Cannes (FR)

(73) Assignee: CLARIANT PRODUCTION (FRANCE) S.A.S., Choisy le Roi (FR)

( * ) Notice: Subject to any disclaimer, the term of this patent is extended or adjusted under 35 U.S.C. 154(b) by 667 days.

(21) Appl. No.: 12/601,631

(22) PCT Filed: May 28, 2008

(86) PCT No.: PCT/EP2008/056551

§ 371 (c)(1),
(2), (4) Date: Mar. 26, 2010

(87) PCT Pub. No.: WO2008/145674

PCT Pub. Date: Dec. 4, 2008

(65) Prior Publication Data

US 2010/0288765 A1 Nov. 18, 2010

(30) Foreign Application Priority Data

May 29, 2007 (FR) ..... 07 03803

(51) Int. Cl.
*B65D 50/04* (2006.01)
*B65D 51/30* (2006.01)
*B65D 41/34* (2006.01)

(52) U.S. Cl.
CPC ..... *B65D 51/30* (2013.01); *B65D 41/3409* (2013.01); *B65D 50/041* (2013.01); *B65D 2215/02* (2013.01)

(58) Field of Classification Search
CPC .. B65D 51/30; B65D 41/3409; B65D 50/041; B65D 2215/02

(Continued)

(56) References Cited

U.S. PATENT DOCUMENTS 3,472,411 A * 10/1969 Turner ..... 215/220
3,837,518 A * 9/1974 Gach ..... 215/365

(Continued)

FOREIGN PATENT DOCUMENTS

DE 3605963 A1 8/1987
EP 0127943 A1 12/1984

(Continued)

OTHER PUBLICATIONS

English translation of International Preliminary Report on Patentability pertaining to international application No. PCT/EP2008/056894. See reference to U.S. Appl. No. 12/666,514, in the Information Disclosure Statement filed on Jan. 11, 2010. This IPRP may contain information material to the patentability of the current application.

*Primary Examiner* — James N Smalley
(74) *Attorney, Agent, or Firm* — Scott R. Cox

(57) ABSTRACT

The invention relates to a child safety closing device (1) associated with a container (2), operating according to a design of two plugs (3, 4) embedded into each other, and allowing a vertical translation movement of the outer plug (4) relative to the inner screw-threaded plug (3) providing an unscrewing possibility and fitted with a first-opening indicator ring (5) connected by breakage bridges (8) to the outer plug (4) capable of vertical translation movement, characterized in that: a) said ring (5) has on its inner surface notches (9) for preventing its rotation when unscrewing the device by interaction with corresponding notches (10) formed on the neck of the associated container inside a peripheral groove (11) outside said collar, in order to induce the braking of the bridges by shearing; b) the upper wall of the groove (11) defines a guiding shoulder (12) for said ring (5) during the vertical translation movement of the ring (5) when connected to the outer plug; c) the notches (10) inside the groove (5) have a height such that they interact with the (Continued)

notches (9) inside the inner face of said ring (5) whatever the position of said ring (5) during the vertical translation movement thereof when connected to the outer plug (4).

17 Claims, 6 Drawing Sheets

(58) Field of Classification Search
USPC ..... 220/212, 801, 256.1, 797, 259.3, 259.4; 215/220, 250, 251
See application file for complete search history.

(56) References Cited

U.S. PATENT DOCUMENTS

| | | | | | |
|---|---|---|---|---|---|
| 3,853,236 | A | * | 12/1974 | Ostrowsky | 215/220 |
| 3,857,505 | A | * | 12/1974 | Mumford et al. | 215/220 |
| 3,888,375 | A | * | 6/1975 | Gerk | 215/219 |
| 3,944,102 | A | * | 3/1976 | Grau | 215/251 |
| 4,284,201 | A | * | 8/1981 | Nixon | 215/220 |
| 4,319,690 | A | * | 3/1982 | Birrell et al. | 215/220 |
| 4,385,705 | A | * | 5/1983 | Kusz | 215/220 |
| 4,394,916 | A | * | 7/1983 | Smalley | 215/220 |
| 4,454,955 | A | * | 6/1984 | Kusz et al. | 215/220 |
| 4,474,301 | A | * | 10/1984 | Davis | 215/220 |
| 4,480,759 | A | * | 11/1984 | Behrens et al. | 215/220 |
| 4,520,938 | A | * | 6/1985 | Finke | 215/220 |
| 4,523,688 | A | * | 6/1985 | Puresevic et al. | 215/220 |
| 4,527,701 | A | * | 7/1985 | Schaubeck | 215/220 |
| 4,550,845 | A | * | 11/1985 | Guala | 215/252 |
| 4,598,833 | A | * | 7/1986 | Herr | 215/220 |
| 4,673,095 | A | * | 6/1987 | Puresevic et al. | 215/220 |
| 4,813,561 | A | * | 3/1989 | Ochs | 215/252 |
| 4,832,218 | A | * | 5/1989 | Gibilisco | 215/220 |
| 4,834,234 | A | * | 5/1989 | Sacherer et al. | 206/204 |
| 4,915,244 | A | * | 4/1990 | Celaschi et al. | 215/252 |
| 4,984,700 | A | * | 1/1991 | Knickerbocker | 215/251 |
| 5,005,718 | A | * | 4/1991 | Buono | 215/220 |
| 5,020,681 | A | * | 6/1991 | Kusz | 215/220 |
| 5,040,692 | A | * | 8/1991 | Julian | 215/252 |
| 5,188,251 | A | * | 2/1993 | Kusz | 215/220 |
| 5,265,744 | A | * | 11/1993 | Duty et al. | 215/220 |
| 5,280,842 | A | * | 1/1994 | Koo | 215/220 |
| 5,317,796 | A | * | 6/1994 | Hunter | 29/434 |
| 5,433,329 | A | * | 7/1995 | Weinstein | 215/220 |
| 5,553,727 | A | * | 9/1996 | Molinaro | 215/44 |
| 5,593,055 | A | * | 1/1997 | Repp et al. | 215/256 |
| 5,611,443 | A | * | 3/1997 | King | 215/220 |
| 5,667,085 | A | * | 9/1997 | Ogden et al. | 215/220 |
| 5,676,268 | A | * | 10/1997 | King | 215/216 |
| 5,743,419 | A | * | 4/1998 | King | 215/217 |
| 5,749,484 | A | * | 5/1998 | Trout | 215/219 |
| 5,762,215 | A | * | 6/1998 | Ogden | 215/220 |
| 5,769,252 | A | * | 6/1998 | Volpe | 215/221 |
| 5,836,465 | A | | 11/1998 | King | |
| 6,029,834 | A | * | 2/2000 | Sanner | 215/215 |
| 6,206,216 | B1 | * | 3/2001 | Stalions | 215/220 |
| 6,325,227 | B1 | * | 12/2001 | Ekkert | 215/252 |
| 7,000,789 | B2 | * | 2/2006 | Miceli et al. | 215/228 |
| 7,111,746 | B2 | * | 9/2006 | Miceli et al. | 215/219 |
| 7,401,707 | B2 | * | 7/2008 | Brozell et al. | 215/220 |
| 7,665,601 | B2 | * | 2/2010 | Portier | 206/204 |
| 7,815,061 | B1 | * | 10/2010 | Robinson et al. | 215/220 |
| 7,850,028 | B2 | * | 12/2010 | Morini | 215/220 |
| 8,056,742 | B2 | * | 11/2011 | Brozell et al. | 215/220 |
| 8,109,396 | B1 | * | 2/2012 | Robinson et al. | 215/220 |
| 2002/0134747 | A1 | * | 9/2002 | Babcock et al. | 215/252 |
| 2004/0195197 | A1 | * | 10/2004 | Miceli et al. | 215/219 |
| 2004/0262251 | A1 | * | 12/2004 | Tauber | 215/220 |
| 2005/0161425 | A1 | * | 7/2005 | Morini | 215/204 |
| 2006/0108313 | A1 | * | 5/2006 | Brozell et al. | 215/220 |
| 2007/0272646 | A1 | | 11/2007 | Lancesseur et al. | |
| 2008/0083758 | A1 | * | 4/2008 | Blendell et al. | 220/522 |
| 2009/0242561 | A1 | * | 10/2009 | Wellman | 220/277 |

FOREIGN PATENT DOCUMENTS

| | | | |
|---|---|---|---|
| EP | 0214711 | A1 | 3/1987 |
| EP | 0297160 | A1 | 1/1989 |
| EP | 0609171 | A1 | 8/1994 |
| EP | 0794128 | A1 | 9/1997 |
| EP | 1002737 | A1 | 5/2000 |
| WO | WO9301098 | A2 | 1/1993 |
| WO | WO9722534 | A1 | 6/1997 |

* cited by examiner

CHILD SAFETY CLOSING DEVICE WITH FIRST OPENING INDICATOR SCREW AND RING

FIELD OF THE INVENTION

The invention relates to a safety closing device for a container, the mouth of which is provided with an external screw thread, a child-proof device, in addition comprising a first-opening indicator and a desiccating element.

The invention relates more particularly to a safety closing device by screwing for a container, comprising an internal stopper to be screwed onto the said container and a coaxial external stopper entirely covering the internal stopper, the external stopper having the ability to drive the internal stopper by means of an engagement system when an axial pressure and a rotation are practiced on the external stopper, the said device being equipped in addition with a first-opening indicator ring cooperating with the neck of the container on which the closing device is mounted and a desiccating element.

PRIOR ART

Closing devices offering safety for children, of the screw stopper type, may be of different natures. In particular the safety may be either the consequence of a deformation by opposing lateral pressure of the stopper allowing release of the unscrewing function, followed by the rotation of the stopper, or a vertical movement triggering a device allowing unscrewing, this vertical movement having to be conducted simultaneously with a rotation.

Child safety stoppers functioning on the principle of a double vertical and rotation movement equipped with a first-opening indicator ring exist. The following documents illustrate these various technical solutions proposed.

Document EP 0214711 describes a child-safety screw stopper of the double stopper type fitting one in the other with vertical movement of the external stopper. Crenellations present on the internal face of the external stopper engage with crenellations present on the external face of the internal stopper when pressure is exerted on the external stopper causing a vertical translation and thus putting the two sets of crenellations in positive contact in order to be able to exert an unscrewing torque.

In addition, the internal stopper comprises a first-opening indicator ring secured to the bottom part of the internal stopper, the said ring comprising a plurality of fixing points for connecting it to the bottom part of the skirt of the internal stopper, the said ring in addition comprising an annular return forcibly positioned beyond a shoulder situated on the neck of the container, when said stopper is screwed. When the stopper is unscrewed, the annular return strikes the shoulder and causes the breakage of the fixing points, thus separating the first-opening indicator ring from the bottom part of the skirt of the internal stopper.

The diameter of the non-return shoulder is greater than the diameter of the screw thread on the neck of the container, and the diameter of the flexible annular return of the first-opening indicator ring is less than the diameter of the non-return shoulder, however the geometry and elasticity of the annular return enable it to pass over the shoulder on a first occasion in the direction of the movement following the screwing of the stopper on the neck of the container but does not permit it the reverse passing.

Document DE 3605963 A1 describes a child-safety screw stopper of the double stopper type with vertical movement of the external stopper. The first-opening indicator ring is formed by an assembly of two components fitting inside the internal stopper. The multiplicity of parts makes such a device particularly complex to produce.

Document EP 297160 describes a child-safety stopper, functioning on the principle of a double vertical and rotation movement, equipped with a first-opening indicator ring. The first-opening indicator ring prevents, when it is present, the vertical movement of the two internal and external stoppers.

However, the breakage of the connecting points between the ring and the bottom part of the stopper does not appear to be the result of a rotation of the stopper but of an independent action on the ring itself at its connection, which requires an additional action on the part of the user.

Document EP 0592580 describes a child-safety stopper that functions on the principle of a double vertical and rotation movement, also equipped with a first-opening indicator ring. The principle of the tearing away of the ring is that of a breakage by traction, the ring being prevented from rising by the presence of a collar present on the neck of the container. The connection micropoints between the ring and the bottom part of the skirt of the internal stopper are broken by the traction force exerted, the said ring comprising an extensible annular zone to allow passage thereof beyond a bevelled shoulder present on the neck of the container but not permitting, through the ratios of the diameters, passage in the opposite direction when the stopper is unscrewed.

Document EP 0609171 describes an effectively double stopper, comprising a first-opening indicator ring adjacent to the bottom periphery of the external stopper, but where the device for tearing the said ring is implemented by circumferential traction. An additional action is thus demanded of the user when the container is first opened.

Document U.S. Pat. No. 4,454,955 describes a screw stopper comprising an internal stopper and an external stopper fitting one in the other and ensuring child safety. Indication of first opening is provided by an attached ring that constitutes an independent component. The mounting of such an assembly is obviously more complex than when the ring is moulded at the same time as the internal stopper making up the child-safety closure device.

Document EP 0127943 also describes a double stopper for providing the unscrewing of the stopper by opposing vertical pressure and rotation movement, the first-opening indicator ring having first to be separated by circumferential tearing.

Document FR 2179029 also describes a double stopper. The first-opening indicator ring is positioned on the internal stopper and is separated by tearing following the vertical movement. There is no serration preventing its rotation when the internal stopper is moved in a circular fashion.

Finally, other types of stoppers exist, not using child protection mechanisms but describing first-opening indicator ring systems based on cooperation between a container neck and a ring. In particular, document FR 2670465 describes a tamper-indicating closure device intended to be used on a container that has a threaded neck with engagement teeth below threads, said closure device being characterised in that it comprises:

- a stopper that has a top and a dependent annular skirt having threads for engaging with the threads on the neck of the container;
- an elastic tamper-indicating band that is connected to the base of the said stopper skirt by means of a plurality of breaking connections spaced apart circumferentially;
- a plurality of engagement teeth spaced apart circumferentially, situated on the said band in order to engage with the engagement teeth situated on the container neck; in which the engagement teeth situated on the said band are spaced apart circumferentially on the band with respect to the engagement teeth situated on the container neck so that, when the closure device is screwed onto the container neck, the engagement teeth situated on the said band pass in sequence over the engagement teeth situated on the container neck.

Thus, the prior art does not describe a tamper-indicating closure device intended to be used on a container with a threaded neck providing child safety by the conjunction of two opposing vertical translation and rotation movements, but also equipped with a desiccant means, and of particularly simple design.

OBJECTS OF THE INVENTION

Numerous objects are therefore assigned to the device according to the invention, so that it can best eliminate the aforementioned drawbacks and so that it provides solutions arranged and improved with respect to the various means used in the known safety closing devices.

A first object of the invention is to provide a safety closing device for a container by screwing, child-proof on unscrewing, this device being composed of two stoppers fitting together, functioning by a means of snapping the external stopper onto the internal stopper by the application of an axial pressure/rotation pair, on the top end wall of the device.

Another object of the invention is to provide a safety closing device for a container by screwing, child-proof on unscrewing, this device comprising a means immediately uncoupling the external driving stopper from the internal driven stopper, as soon as the pressure exerted on the top end wall of the device ceases.

Another object of the invention is to provide a safety closing device for a container by screwing, child-proof on unscrewing, the means of which, allowing the engagement and disengagement of the external driving stopper with the internal driven stopper, do not, in whole or in part, suffer fatigue, permanent deformation or rupture through the repetition of the application of the axial pressure/rotation pair on the top end wall of the said device.

Another object of the invention is to provide a safety closing device for a container by screwing, child-proof on unscrewing, the means of which, allowing the engagement and disengagement of the external driving stopper and the internal driven stopper, compensate for the adjustment or wear clearances between the external and internal stoppers, and procure for them excellent cohesion when they are engaged, and independence, without clearance, when they are disengaged.

Another object of the invention is to provide a safety closing device for a container by screwing, child-proof on unscrewing, comprising a desiccant means integrated in the said closure means.

Another object of the invention is to provide a safety closing device for a container by screwing, child-proof on unscrewing, comprising a desiccant means integrated in the said closure means and a tamper-evident indicator.

Another object of the invention is to provide a safety closing device for a container by screwing, child-proof on unscrewing, comprising a desiccant means integrated in the said closure means and a first-opening indicating means cooperating with the neck of the container on which the closing device is screwed.

SUMMARY OF THE INVENTION

Consequently the invention concerns a child-safety closing device associated with a container, operating according to the architecture of two stoppers fitted one in the other, allowing a vertical translation movement of the external stopper with respect to the internal stopper with a screw thread, giving rise to a possibility of unscrewing and equipped with a first-opening indicating ring secured, by breakable bridges, to the external stopper able to move in vertical translation, and which is characterised in that:

a) the said ring has, on its internal face, serrations, the function of which is to prevent its rotation, when the device is unscrewed, by cooperating with corresponding serrations disposed on the neck of the associated container and inside a peripheral groove external to the said neck, with a view to causing the breakage of the bridges by shearing, b) the top wall of the peripheral groove external to the said neck constitutes a guide shoulder for the said ring in the vertical translation movement of the ring when the said ring is secured to the external stopper, c) the serrations placed inside the peripheral groove external to the said neck are of a height such that they cooperate with the serrations present on the internal face of the said ring, whatever the position of this ring during its vertical translation movement when secured to the external stopper.

DETAILED DESCRIPTION OF THE INVENTION

The closure device for a threaded container according to the invention is composed of two stoppers, one internal, the other external, fitted one in the other, and partly able to move in translation one with respect to the other. The internal stopper has a screw thread enabling it to be screwed onto the neck of a container. The external stopper comprises a first-opening indicating ring, connected to the said external stopper by breakable bridges, the said ring being equipped with serrations cooperating with corresponding serrations positioned on the base of the neck of the container inside a groove formed by respectively, towards the bottom, the bulging of the container body and, towards the top, by the bottom part of a shoulder surrounding the neck of the container.

The internal stopper also comprises a housing for storing a desiccant composition or element.

The external stopper of the child-safety closing device according to the invention comprises a first-opening indicating tamper-evident ring, secured by breakable bridges to the external stopper able to move in vertical translation.

The closure device with screw thread is intended for a container of the, for example, blow-moulded bottle type, comprising a neck preferentially with three threads and a steep pitch, and a peripheral groove external to the said neck, the top wall of which constitutes the guide shoulder for the said ring in the vertical translation movement of the ring when secured to the external stopper.

The first-opening indicator ring has, on its internal face, serrations the function of which is to prevent rotation thereof, when the device is unscrewed, by cooperating with corresponding serrations disposed on the neck of the associated container, inside the peripheral groove external to the said neck, and this with a view to causing the breakage of the bridges by shearing.

The top wall of the groove constitutes a guide shoulder for the said ring in the vertical translation movement of the ring when secured to the external stopper.

The serrations placed inside the groove are of a height such that they cooperate with the serrations present on the internal face of the said ring, whatever the position of this ring during its vertical translation movement when secured to the external stopper. Thus, the serrations placed inside the external peripheral groove have a height greater than the serrations placed on the internal face of the ring, which is no more than the height of the said groove.

The breakage of the breakable bridges connecting the top circumference of the ring to the bottom circumference of the external stopper takes place by shearing at first opening and thus represents evidence of tampering. The evenly distributed serrations mean that the ring thus remains locked in rotation, thus causing the tearing of the breakable bridges and therefore the disconnection of the ring with respect to the external stopper.

The breakable bridges can be at least three in number and preferentially eight in number for reasons of balancing of shearing force when the child-safety closing device is first unscrewed and for reasons of ease of mould design.

The serrations are present at the rate of at least two both on the internal face of the ring and inside the external peripheral groove. These serrations may be identical or different in number both on the internal face of the ring and inside the external peripheral groove.

The serrations are preferentially three in number on the internal face of the ring and inside the external peripheral groove, distributed at 120° in a regular fashion, also for reasons of balancing of force at the time of the first unscrewing of the child-safety closing device and for reasons of ease of mould design.

The profile of the serrations present on the internal face of the ring and inside the peripheral groove of the neck of the associated container is such that it enables the internal stopper to be screwed, due to the fact that the profile has a gentle slope in the direction of screwing, giving rise to a deformation of the first-opening indication tamper-evidence ring but not allowing its unscrewing without breakage of the bridges connecting the first-opening indicating ring to the bottom part of the external stopper, because of an abrupt profile or abrupt slope that prevents any rotation of the said ring when the closing device is unscrewed, and which is radially oriented.

The serrations disposed on the neck of the container are situated below a shoulder that is an integral part of the neck of the container and also guides the ring when the closing device is screwed on the threaded neck of the container, that is to say at the time of the first downward movement of the external stopper. In addition the said shoulder protects the serrations disposed on the neck of the associated container while preventing their appearing protuberant with respect to the said neck.

Any attempt to rotate the first-opening indicating ring secured to the stopper, when the stopper is unscrewed, causes the breakage of the breakable bridges connecting the top periphery of the ring to the bottom periphery of the external stopper, since this ring is locked in rotation by the serrations disposed on the neck of the container in the external peripheral groove, while the stopper can for its part perform this rotation.

The ring, in addition, must be able to maintain its freedom of vertical movement to allow the vertical translation of the external stopper and therefore permit the engagement of the internal annulus elements of the external stopper and the external annulus elements of the internal stopper with a view to allowing the unscrewing of the stopper in the context of the deployment of this child safety.

The regularly spaced serrations disposed on the internal face of the first-opening indicating ring have a height less than the serrations disposed on the external surface of the container neck, housed just below the shoulder present on the said neck, so that the serrations disposed on the internal face of the ring are positioned on this side of the said shoulder when the external stopper is in the high position, that is to say not acted on. In addition, the said serrations also have a bevel allowing facilitated passage thereof by extension of the ring beyond the said shoulder, itself bevelled in shape in order to facilitate the passage of the ring when the closure device is first screwed.

The first-opening indicating ring, once disconnected, by breakage of the breakable bridges, from the bottom circumferential part of the external stopper, may either remain present in the external peripheral groove of the container, through the fact that the diameter of the said container is greater than the diameter of the ring, or be removed when the closing means is opened.

The device according to the invention is composed of two stoppers, one internal, the other external, fitted one in the other, each of the stoppers being provided on their superstructure with means of driving on the internal surfaces of the external stopper and on the external surfaces of the internal stopper such that the external stopper, when it is subjected to an axial pressure, and then a rotation, can move vertically through a descending movement, and snap into the internal stopper and thus drive it in an opening, or closing, movement as required.

As soon as the axial pressure ceases on the external stopper, the device, in order to be truly secure, must provide the reverse ascending movement of the external stopper, by causing the disengagement of the external and internal stoppers: as soon as the external stopper is in its disengaged position and is subjected to a single rotation action, it can no longer drive the internal stopper in an unscrewing movement.

According to the invention, the engagement means placed opposite on the internal surface of the top end wall of the external stopper and on the external surface of the top end wall of the internal stopper are formed on each of these surfaces, by an annulus of teeth, the apparent diameter of which, which is less than that of the stoppers, is preferably the same for each of the annuli.

The teeth each forming annuli are spaced apart from one another such that the teeth on the annulus of the external stopper can fit between the teeth of the annulus of the internal stopper when the external stopper is subjected to an axial pressure and then to an initiation of a rotation.

The teeth on the annuli enabling the external stopper to engage in the internal stopper have the shape of a:

- parallelepiped terminating at their mechanical engagement end in two symmetrical oblique planes, separated from each other by a horizontal plane,
- parallelepipedal or cylindrical, terminating at their mechanical engagement end in a hemisphere or a truncated cone.

This particular form of the teeth is designed so that the external stopper, when it is not subjected to an axial pressure, but only subjected to a rotation movement, can turn without driving the internal stopper, the teeth on the annulus of the external stopper being able to slide over the teeth on the annulus of the internal stopper, if they are in contact with them, without engaging in one another.

The number of teeth present in each annulus depends essentially on the diameter of these annuli.

The external stopper also comprises, on the internal surface of the top end wall in contact with the external surface of the top end wall of the internal stopper, a deformable spacing means with shape memory capable of deforming when a downward vertical pressure is exerted on the external stopper, thus allowing the engagement of the driving means. When the pressure is removed, the deformable spacing means with shape memory reacts and once again creates a space, by virtue of its capacity to regain its initial shape, between the internal top end walls of the two stoppers, while disengaging the driving means.

The deformable spacing means with shape memory can, for example, consist of helical segments, segments of tongues positioned in a circle, forming a kind of splayed mini-skirt secured to the internal face of the external stopper, each of the segments having the ability to fold elastically about its connection line with the internal face of the external stopper when pressure is exerted on these segments. The splayed mini-skirt regains its initial shape when the pressure ceases.

In order to facilitate this crushing of the tongue segments positioned in a circle, forming a kind of splayed mini-skirt, these are positioned in line with a corresponding slightly conical and protuberant surface positioned on the top surface of the internal stopper. Thus the internal surface formed by each of the segments of the splayed skirt is guided by the slightly conical external surface of the protuberance, positioned on the external surface of the internal stopper, so as to increase this splay reversibly.

The internal stopper and the external stopper cannot, once assembled, be separated from each other because of an internal cylindrical bulge placed at the bottom part of the internal surface of the skirt of the external stopper, which can deform when the external stopper is mounted on the internal stopper, but which acts as a non-return element making such removal impossible.

Such a device has high safety with regard to young children, the coordination of whose actions, in order to simultaneously create the axial pressure/rotation pair necessary for opening the device, is not yet acquired.

According to the invention, the means of guiding the external stopper with regard to the internal stopper, in order to provide excellent coaxiality, may possibly be present on one and/or the other of the cylindrical lateral walls of each of the stoppers, on the external surface of the internal stopper and/or on the internal surface of the external stopper.

According to the invention, the seal between the internal part of the neck of the container and the stopper with an internal thread is provided by means of a cylindrical element with a certain height, coaxial with the internal stopper and positioned inside the internal stopper and fitting by means of an end bevel in the neck of the container.

The internal stopper of the child-safety closing device according to the invention also comprises a desiccating means of the attached type, the desiccant being placed in a suitable housing, situated on the bottom of the internal stopper, the said housing being closed by a closure means not impervious to ambient moisture, for example a membrane made from porous cardboard, in order to ensure rapid desiccation of the products sensitive to moisture and packaged in the container.

The desiccant used in the container is chosen from the group consisting of silica gels, molecular sieves, diatomaceous earths or other desiccants, in powder form or deposited on a powdery medium.

The desiccant may also be a capsule contained in the said housing and produced from a desiccant polymer material containing desiccant fillers or not.

As is the case with the safety closing devices belonging to the prior art, the external and internal stoppers of the device according to the invention are produced by injection moulding of compositions formulated from thermoplastic polymers, chosen from the group consisting of polyethylenes, polypropylenes and ethylene/propylene copolymers used alone or in a mixture, formulated or not.

Other thermoplastic polymers can also be used, such as polyamides (PA), polystyrenes (PS), acrylonitrile-butadiene-styrene copolymers (ABS), styrene-acrylonitrile copolymers (SAN), polymethyl methacrylates (PMMA), polybutyleneterephthalates (PET, polybutyleneterephthalates (PBT), polyacetals (POM), polyvinyl chlorides (PVC) or polycarbonates (PC).

Thermoplastic elastomers can be added to such compositions formulated from the aforementioned thermoplastic polymers.

The invention will be better understood by means of the numbered description of the figures mentioned below, these figures having only an illustrative non-limitative character.

FIG. 1 is a transverse section of the desiccant closing device (1), with child safety and first-opening indicating ring (5) mounted by screwing on the corresponding container (2) according to the invention.

Figure 1:
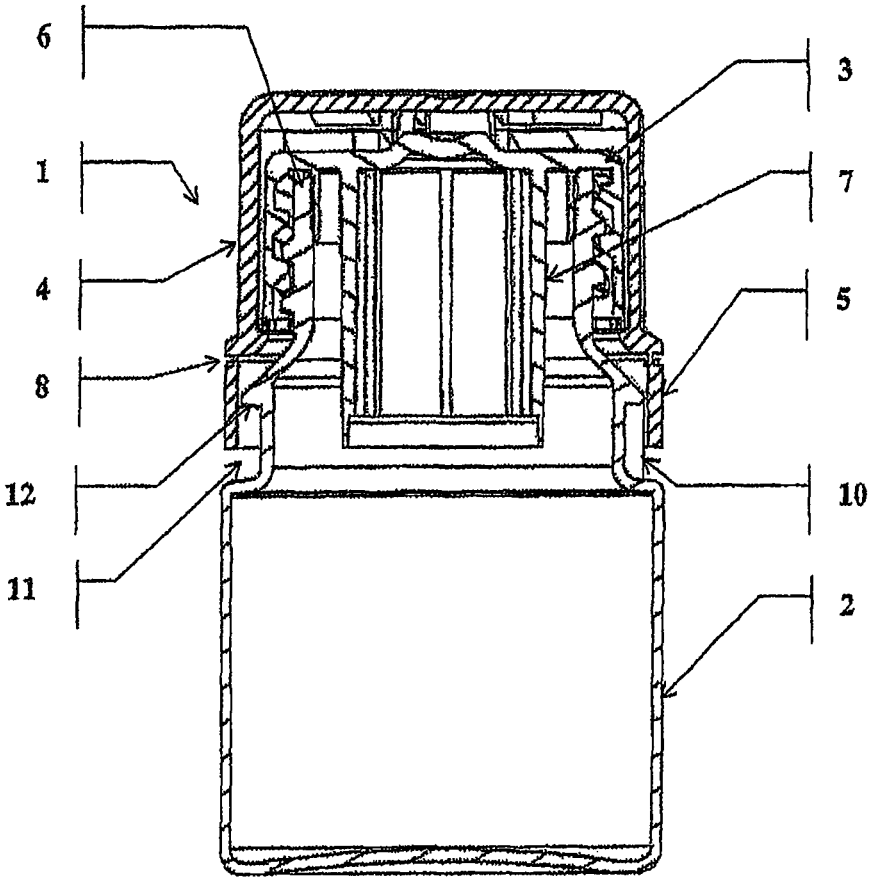
FIG. 1 is a transverse section of the desiccant closure device, with child safety and first-opening indicating ring, mounted by screwing on the corresponding container according to the invention.

The closing device (1) of the threaded container (2) according to the invention is composed of two stoppers, one internal (3), the other external (4), fitted one in the other, and partly movable in translation one with respect to the other, the internal stopper (3) comprising a screw thread enabling it to be screwed onto the neck (6) of the said container (2), and also comprising a housing (7) for storing a desiccant composition or a desiccant element, the external stopper (4) in addition comprising a first-opening indicating ring (5), connected to the said external stopper (4) by breakable bridges (8), the said ring (5) being equipped with serrations (9) cooperating with corresponding serrations (10) positioned on the base of the neck (6) of the container (2), at a groove (11) formed by respectively, downwards, the bulging of the body of the container and, upwards, by the bottom part of a shoulder (12).

Figure 2:
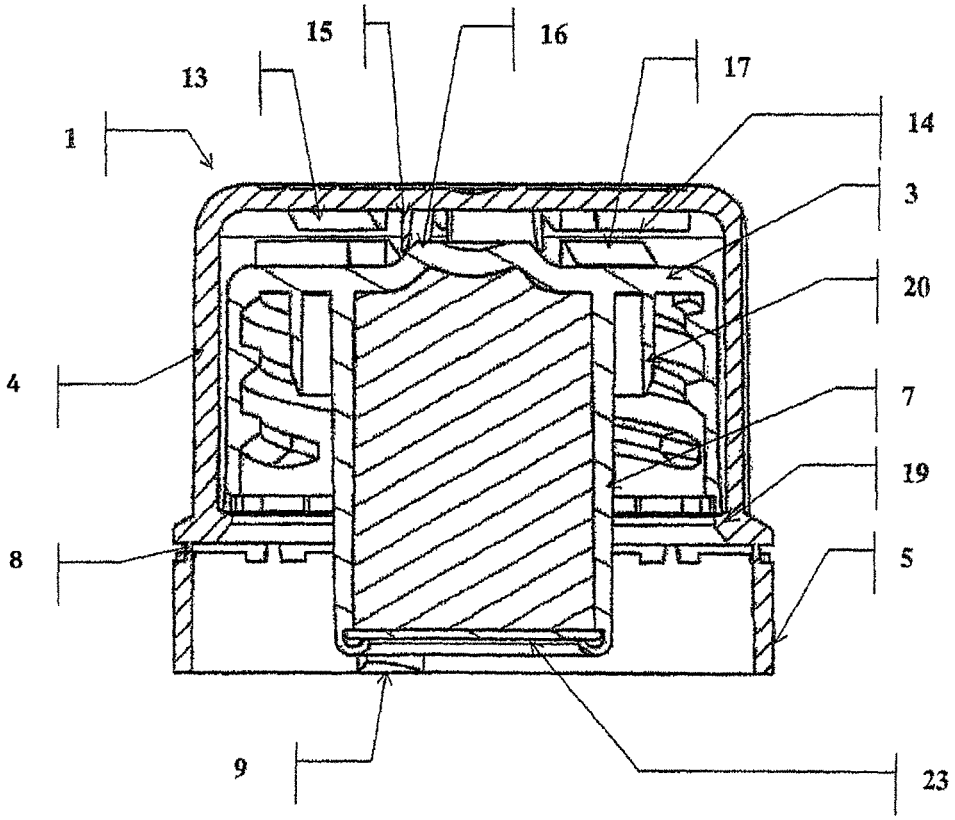
FIG. 2 is a transverse section solely of the closing device according to the invention comprising the external stopper equipped with its first-opening indicating ring and the internal stopper, captive in the external ring.

FIG. 2 is a transverse section solely of the closing device (1) according to the invention comprising the external stopper (4) equipped with its first-opening indicating ring (5) and the internal stopper (3), captive in the external stopper (5) but able to move in translation one with respect to the other. The two stoppers, fitted one in the other, are each provided on their superstructure with means such that the external stopper, when it is subjected to an axial pressure, and then a rotation, moves vertically by a descending movement, engages in the internal stopper and drives it in an opening (or closing) movement as required.

The external stopper (4) also comprises, on its internal face in contact with the external face of the internal stopper (3), a deformable spacing means (15) with shape memory, capable of deforming when a downward vertical pressure is exerted on the external stopper (4), thus allowing the engagement of the teeth (17) of the annuli. When the pressure is removed, the deformable spacing means with shape memory once again acts and spaces, by virtue of its ability to regain its initial shape, the internal face in contact with the external face of the internal stopper disengaging the teeth of the annuli.

The deformable spacing means with shape memory (15) is formed by a plurality of tongue segments positioned in a circle, forming a kind of splayed mini-skirt secured to the internal face of the external stopper (4), each of the segments having the ability to fold elastically around its connection line with the internal face of the external stopper when pressure is exerted on these segments. The splayed mini-skirt regains its initial shape when the pressure ceases.

In order to facilitate this crushing of the tongue segments position in a circle forming a kind of splayed mini-skirt, these are positioned in line with a corresponding slightly conical and protuberant surface (16) positioned on the top surface of the internal stopper (3).

The internal stopper (3) and the external stopper (4) cannot, once assembled, be separated from each other because of an internal cylindrical bulge (19) at the bottom part of the skirt of the external stopper (4), which can deform when the external stopper is mounted on the internal topper, but which acts as a non-return element making such removal impossible.

According to the invention, the seal between the internal part of the neck (6) of the container (2) and the stopper with internal thread (3) is provided by means of a cylindrical element (20) of a certain height concentric with the internal stopper (3) and positioned inside the internal stopper (3) and being adjusted by means of an end bevel in the neck (6) of the container (2).

The external stopper (4) of the closure device (1) according to the invention comprises a first-opening indicating tamper-evident ring (5). The closure device with screw thread is intended for a container of the blow-moulded bottle type for example, comprising a neck (6) preferentially with three threads and a steep pitch, a shoulder collar (12) and groove (11) for retaining the tamper-evident ring (5), and regularly distributed serrations (10) for implementing the tamper evidence by virtue of the tearing away caused by the said ring (5), which thus remains locked with respect to rotation, by virtue of the corresponding serrations (9) identical in number to the serrations (10) present on the neck of the container, positioned on the inside of the ring (5), the breakage of the breakable bridges (8) connecting the top circumference of the ring (5) to the bottom circumference of the external stopper (4) consequently taking place by shearing.

The serrations (9, 10) are preferentially three in number distributed at 120° degrees.

The profile of the serrations (9, 10) present on the internal circumferential part of the external stopper and on the outside of the neck of the associated container is such that it enables the internal stopper (3) to be screwed, due to a profile with a gentle slope (21), causing a deformation of the first-opening indicating tamper-evident ring but not enabling it to be unscrewed because of an abrupt profile (22), breakable bridges (8) connecting the first-opening indicating ring (5) to the bottom part of the external stopper (4), the said abrupt profile (22) preventing any rotation of the said ring (5) when the closure device (1) is unscrewed.

The serrations (10) disposed on the neck (6) of the container (2) are situated below a shoulder (12) that forms an integral part of the neck (6) of the container (2) and also guides the ring when the closure device is screwed on the threaded neck (6) of the container, that is to say when the external stopper (4) first moves downwards.

The serrations (10) are in addition contained in a groove (11) formed by the shoulder (12) and by a bulge on the body of the container.

Any attempt to rotate the first-opening indicating ring (5) secured to the external stopper (4), when the internal stopper (3) is unscrewed, causes the breakage of the breakable bridges (8) connecting the top periphery of the ring (5) to the bottom periphery of the external stopper (4), since this ring (5) is locked with respect to the rotation by the serrations (9) disposed inside the said ring, cooperating with the serrations (10) disposed on the neck (6) of the container (2), at the groove (11), while the internal stopper (3) driven by the external stopper (4) can make this rotation.

The ring (5) keeps its freedom of vertical movement to allow the vertical translation of the external stopper (4) and therefore to allow the engagement of the internal annulus elements of the external stopper (4) and the external ring elements of the internal stopper (3) with a view to allowing the unscrewing of the stopper in the context of the deployment of this child safety.

The regularly spaced serrations (9), disposed on the inside of the first-opening indicating ring (5), have a height less than the serrations (10) disposed on the external surface of the neck (6) of the container, housed just below the shoulder (12) present on the said neck, so that the serrations (9) disposed on the inside of the ring are positioned on this side of the said shoulder (12) when the external stopper (4) is in the high position, that is to say not acted on. In addition, the said serrations (9) also have a bevel allowing passage thereof facilitated by extension of the ring (5) beyond the said shoulder (12), itself bevelled in form in order to facilitate the passage of the ring (5) when the closing device (1) is first screwed.

The first-opening indicating ring (5), once disconnected by breakage of the breakable bridges (8) from the bottom circumferential part of the external stopper (4), can either remain present on the container by virtue of the fact that the diameter of the top container is at the diameter of the ring, or be removed during the opening of the closing means (1).

The internal stopper (3) of the device (1) according to the invention also comprises a desiccant means of the attached type, the desiccant being placed in a suitable housing (7), situated on the bottom of the internal stopper (3), the said housing (7) being closed by a closure means not impervious to ambient moisture, for example a membrane (23) made from porous cardboard, to ensure the rapid desiccation of the products sensitive to moisture and packaged in the container.

Figure 3:
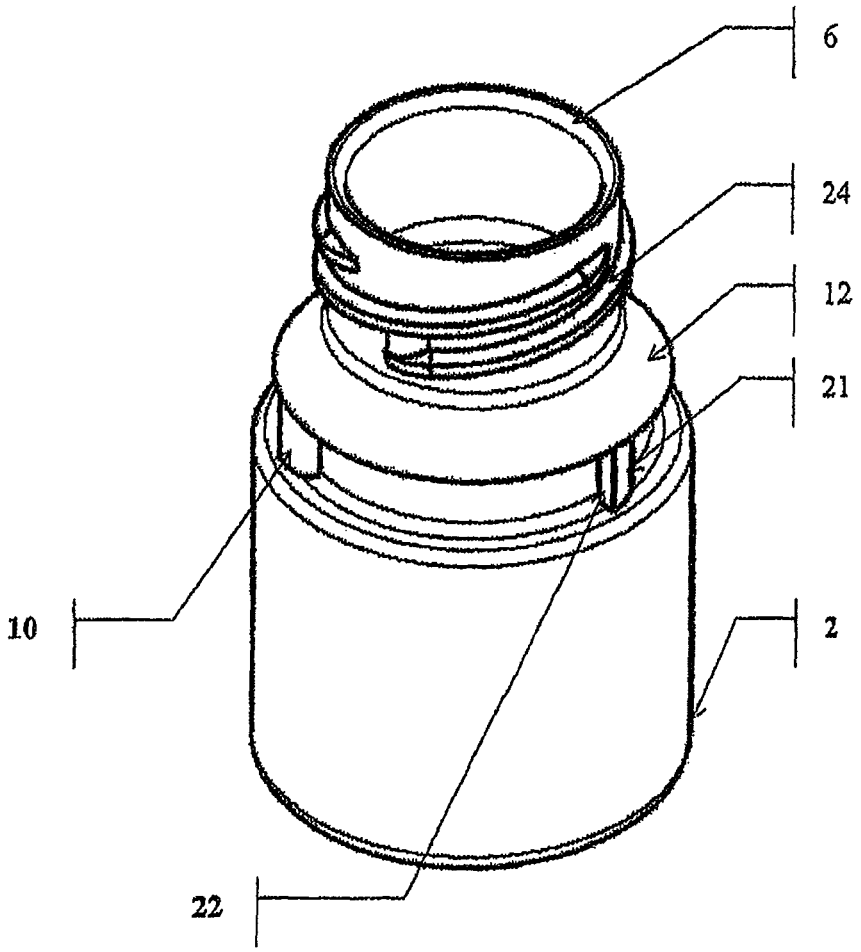
FIG. 3 is a perspective view of the container on which the child-safety closing device with first-opening indicating ring is screwed.

FIG. 3 is a perspective view of the container (2) on which the child-safety closing device (1) with a first-opening indicating ring (5) according to the invention is screwed. The neck (6) of the container (2) comprises a triple screw thread (24), a shoulder (12) forming, with the bulge on the body of the container (2), a groove (11) in which there are positioned three serrations (10) the height of which corresponds to the width of the groove (11).

These serrations (9) have a surface in a gentle slope (21) and a surface in an abrupt slope (22). This serration profile (9, 10) in a gentle slope (21) consequently makes it possible to make the corresponding serrations (9) positioned inside the circumferential surface of the ring (5) pass over the serrations (10) at the time of the operation of initial closure of the container (2) by the closing device (1), but does not allow unscrewing thereof without breakage by shearing of the breakable bridges, by virtue of the fact that the ring (5) can no longer turn, the abrupt faces (22) of the serrations (10) coming to oppose the abrupt faces of the serrations (9) positioned inside the circumferential surface of the ring (5). The first-opening indicating ring (5) is consequently released.

Figure 4:
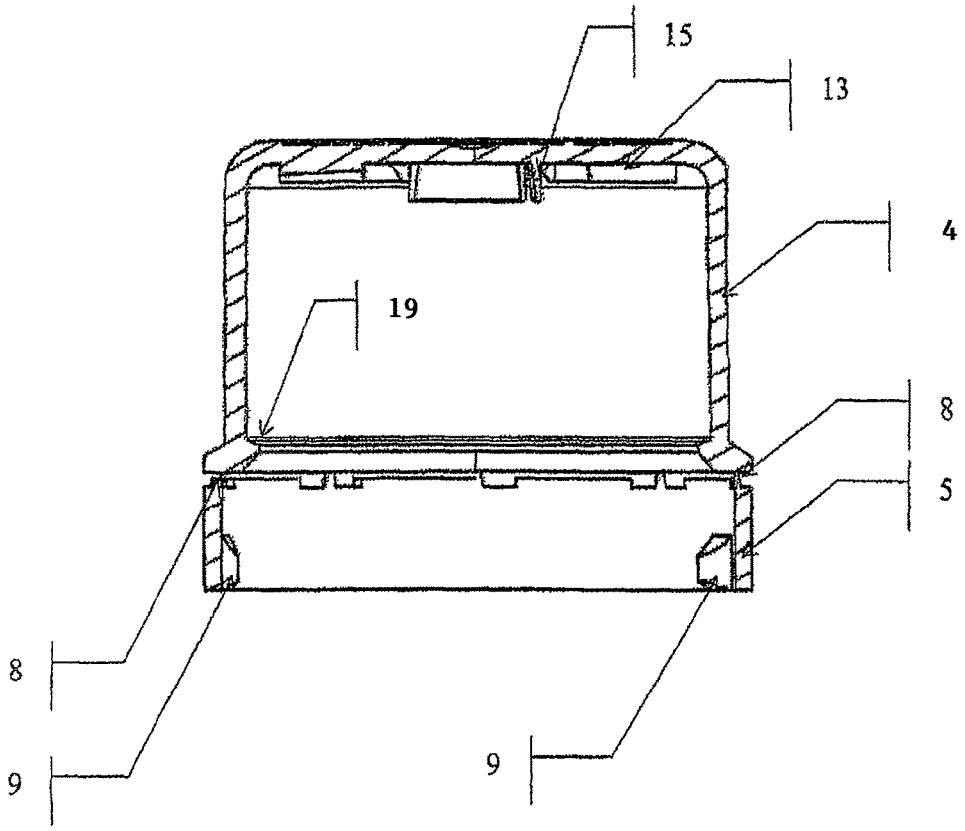
FIG. 4 is a transverse section of the external stopper of the device according to the invention.

FIG. 4 is a transverse section of the external stopper (4) of the device (1) according to the invention equipped with its first-opening indicating ring (5) connected by a plurality of breakable bridges (8) to the bottom periphery of the external stopper (4). The shoulder (19) makes it possible to make the internal stopper (3) captive of the external stopper (4) while allowing them mobility in translation. The low serrations (9) appear on the internal peripheral surface of the first-opening indicating ring (5). The external stopper (4) comprises, on its internal flat face, teeth (13) and a deformable spacing means (15) with shape memory in the form of skirt segments.

Figure 5:
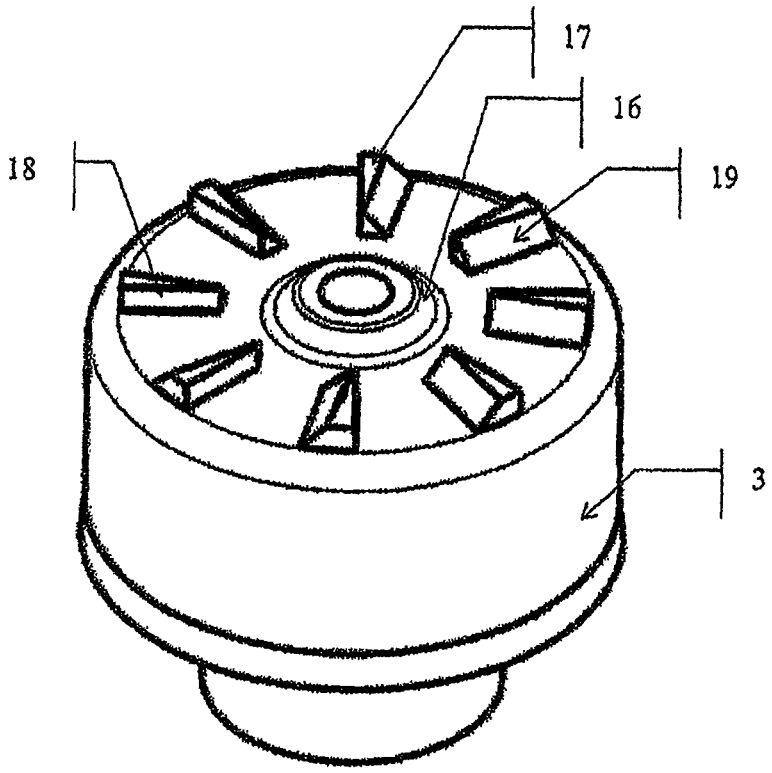
FIG. 5 is a perspective view of the internal stopper, showing in particular the serrated annulus.

FIG. 5 is a perspective view of the internal stopper showing in particular the snapping-on means (14) placed on the external surface of the top end wall of the internal stopper of the serrated annulus type.

The teeth (17), eight in number forming the annulus, are spaced apart from one another so that the teeth on the annulus of the external stopper can fit between the teeth on the annulus of the internal stopper when the external stopper is subjected to an axial pressure and then to the start of a rotation.

Each tooth (17) has a vertical plane (18) that corresponds to a plane of a radial section of the internal stopper, and an opposite oblique plane (19). The vertical plane (18) enables snapping in with the corresponding vertical plane of the tooth on the serrated annulus situated on the inside of the external stopper, at the time of unscrewing, while the oblique plane on the other hand lifts the corresponding plane of the tooth that is opposite to it during the screwing operation.

This particular form of the teeth is designed so that the external stopper, when it is not subjected to an axial pressure but subjected only to a rotation movement, can turn without driving the internal stopper, the teeth on the annulus of the external stopper being able to slide over the teeth on the annulus of the internal stopper, if they are in contact with them, without engaging in one another.

Figure 6:
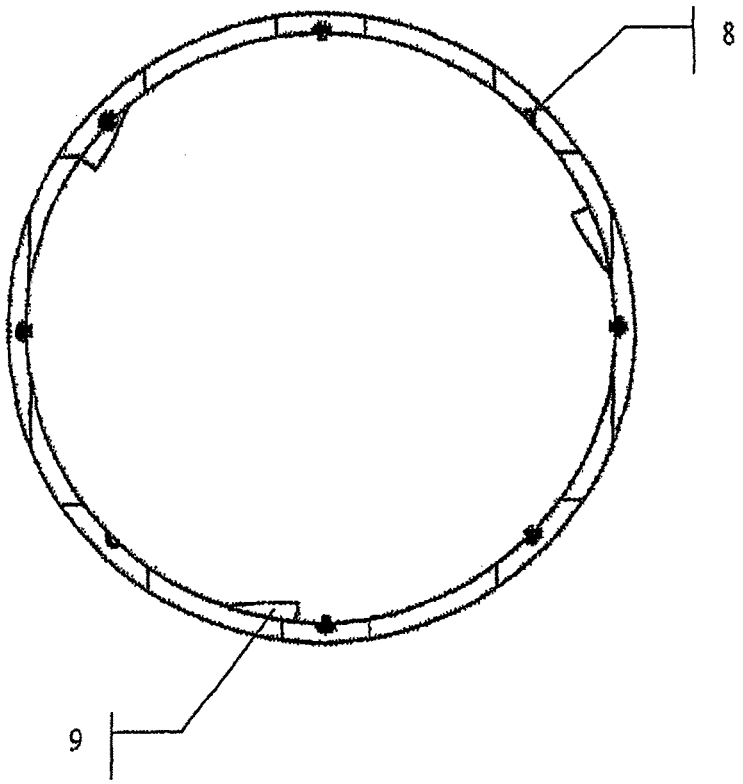
FIG. 6 is a section along a plane at the join between the top part of the first-opening indicating ring and the bottom part of the external stopper of the closure device showing the three serrations and the eight breakable links or bridges connecting the top circumference of the first-opening indicating ring to the bottom circumference of the skirt of the external stopper.

FIG. 6 is a section along a plane at the join between the top part of the first-opening indicating ring and the bottom part of the external stopper of the closing device showing the three serrations (9) and the eight breakable links or bridges (8) connecting the top circumference of the first-opening indicating ring to the bottom circumference of the skirt of the external stopper.

Such a safety closure device for a container, the mouth of which is provided with an external screw thread, a child-proof device, comprising in addition a first a first-opening indication and a desiccant, is used for closing a container, making it possible to store products sensitive to moisture such as for example pharmaceutical or other products, to be consumed over time, and for which it is important to protect use thereof by the end consumer, who must be totally reassured, that is to say assured of the physical integrity of the package before first opening on the one hand and on the other hand assured that such products cannot be consumed by children, and this since such child safety is sufficiently effective.

The invention claimed is:

1. Child-safety closing device and container, wherein the child-safety closing devices comprises an external and threaded internal stopper fitting one in the other, wherein a vertical translation movement of the external stopper with respect to the threaded internal stopper, is allowed and gives rise to a possibility of unscrewing, and wherein the external stopper further comprises a first-opening indicating ring secured by breakable bridges to the external stopper, which move in vertical translation with respect to the threaded internal stopper before the breakable bridges are fractured upon first opening, wherein a) the first-opening indicating ring has, on its internal face, serrations, the function of which is to prevent rotation thereof when the device is unscrewed by engaging with corresponding serrations disposed on a neck of the container and inside a peripheral groove external to the neck, with a view to causing breakage of the bridges by shearing, and wherein b) a top wall of the peripheral groove external to the neck constitutes a guide shoulder for the first-opening indicating ring in the vertical translation movement of the first-opening indicating ring when the first-opening indicating ring is secured to the external stopper, and wherein c) the serrations disposed on the neck of the container and placed inside the peripheral groove external to the neck are of a height that does not exceed the height of the peripheral groove and that is sufficiently greater than the height of the serrations present on an internal face of first-opening indicating ring to thereby maintain freedom of vertical translation movement of the first-opening indicating ring when secured to the external stopper facilitating unscrewing and such that they engage with the serrations present on the internal face of the first-opening indicating ring, whatever the position of this first-opening indicating ring in its vertical translation movement when secured to the external stopper;

d) and wherein the first-opening indicating ring, which is secured by the breakable bridges to the external stopper, is movable in vertical translation with the external stopper independent of and without resulting in rotational movement of the threaded internal stopper and e) wherein each of the internal and external stoppers further comprises on their superstructure a driving mechanism, wherein one driving mechanism is located on the internal surface of the external stopper and a second driving mechanism is located on the external surface of the threaded internal stopper, such that the external stopper, when it is subjected to an axial pressure and then a rotation, engages the threaded internal stopper and drives it, by means of interaction of the respective driving mechanisms, as required for an opening movement, and f) characterised in that the external stopper further comprises on the internal surface of the top end wall in contact with the external surface of the top end wall of the threaded internal stopper deformable spacing elements with shape memory capable of deforming when a vertical downward pressure is exerted on the external stopper allowing engagement of these driving means, characterised in that the deformable spacing elements with shape memory comprise segments of tongues positioned in a circle, forming a splayed mini-skirt secured to the internal face of the external stopper, each of the segments having the ability to fold elastically around its connection line with the internal surface of the top end wall of the external stopper when pressure is exerted on these segments, and g) wherein the deformable spacing elements separate teeth on the internal surface of the external stopper from interaction with teeth of the external surface of the threaded internal stopper unless both axial pressure and rotational pressure are applied to the external stopper.

2. Child-safety closing device according to claim 1, characterised in that the serrations disposed on the neck of container and placed inside the peripheral groove have a height no more than that of the peripheral groove.

3. Child-safety closing device according to claim 1, characterised in that the serrations on the internal face of the first-opening indicating ring and the serrations inside the peripheral groove are identical or different in number.

4. Child-safety closing device according to claim 1, characterised in that the serrations on both the internal face of the first-opening indicating ring and inside the peripheral groove are preferentially three in number and distributed in a regular fashion.

5. Child-safety closing device according to claim 1, characterised in that the profile of the serrations present on both the internal face of the first-opening indicating ring and inside the peripheral groove on the neck of the container have a gentle slope in the screwing direction and an abrupt slope of radial orientation in the unscrewing direction.

6. Child-safety closing device according to claim 1, characterised in that the driving mechanism on the superstructure on the internal surface of the top end wall of the external stopper and on the external surface of the top end wall of the threaded internal stopper comprise teeth placed in an annulus of the respective surfaces.

7. Child-safety closing device according to claim 6, characterised in that the teeth forming an annulus are spaced apart from one another.

8. Child-safety closing device according to claim 6, characterised in that the teeth are in the shape of a parallelepiped terminating at their mechanical engagement end in two symmetrical oblique planes, separated from each other by a horizontal plane.

9. Child-safety closing device according to claim 1, characterised in that the external stopper comprises at the bottom end of the internal surface of its skirt an internal cylindrical bulge that acts as a non-return element with regard to the threaded internal stopper.

10. Child-safety closing device according to claim 1, further comprising a means of guiding the external stopper with regard to the threaded internal stopper, in order to provide excellent coaxiality, the means being present on one and/or the other of the stoppers, on the external surface of the threaded internal stopper and/or on the internal surface of the external stopper.

11. Child-safety closing device according to claim 1, characterised in that, in order to establish the seal between the internal part of the neck of the container and the threaded internal stopper with internal thread, the threaded internal stopper is provided with a coaxial cylindrical element, positioned inside the stopper, adjusting by means of an end bevel in the neck of the container.

12. Child-safety closing device according to claim 1, characterised in that the threaded internal stopper of the device further comprises a desiccant means of the respective type, the means comprising a suitable housing, situated on the bottom of the threaded internal stopper, in which a desiccant is placed, the said housing being closed by a closure means not impervious to ambient moisture, for example a membrane made from porous cardboard, to ensure rapid desiccation of the products sensitive to moisture and packaged in the container.

13. Child-safety closing device according to claim 12, characterised in that the desiccant is chosen from the group consisting of silica gels, molecular sieves, diatomaceous earths, in the form of a powder or deposited on a powdery medium and in the form of a capsule produced from a desiccant polymer material containing desiccant fillers.

14. Child-safety closing device according to claim 1, characterised in that it is formulated from thermoplastic polymers chosen from the group consisting of polyethylenes, polypropylenes, ethylene/propylene copolymers used alone or in a mixture, formulated or not, polyamides (PA), polystyrenes (PS), acrylonitrile-butadiene-styrene copolymers (ABS), styrene-acrylonitrile copolymers (SAN), polymethyl methacrylates (PMMA), polybutyleneterephthalates (PET, polybutyleneterephthalates (PBT), polyacetals (POM), polyvinyl chlorides (PVC) and polycarbonates (PC).

15. Child-safety closing device according to claim 14, characterised in that the compositions formulated from thermoplastic polymers comprise thermoplastic elastomers.

16. Child-safety closing device and container, wherein the child-safety device comprises an external and threaded internal stopper fitting one in the other, wherein a vertical translation movement of the external stopper with respect to the threaded internal stopper, is allowed and gives rise to a possibility of unscrewing, and wherein the external stopper further comprises a first-opening indicating ring secured by breakable bridges to the external stopper, which move in vertical translation with respect to the threaded internal stopper before the breakable bridges are fractured upon first opening, wherein a) the first-opening indicating ring has, on its internal face, serrations, the function of which is to prevent rotation thereof when the device is unscrewed by engaging with corresponding serrations disposed on a neck of the container and inside a peripheral groove external to the neck, with a view to causing breakage of the bridges by shearing, and wherein b) a top wall of the peripheral groove external to the neck constitutes a guide shoulder for the first-opening indicating ring in the vertical translation movement of the first-opening indicating ring when the first-opening indicating ring is secured to the external stopper, and wherein c) the serrations disposed on the neck of the container and placed inside the peripheral groove external to the neck are of a height that does not exceed the height of the peripheral groove and that is sufficiently greater than the height of the serrations present on an internal face of first-opening indicating ring to thereby maintain freedom of vertical translation movement of the first-opening indicating ring when secured to the external stopper facilitating unscrewing and such that they engage with the serrations present on the internal face of the first-opening indicating ring, whatever the position of the first-opening indicating ring in its vertical translation movement when secured to the external stopper;

d) and wherein the first-opening indicating ring, which is secured by the breakable bridges to the external stopper, is movable in vertical translation with the external stopper independent of and without resulting in rotational movement of the threaded internal stopper and e) wherein each of the internal and external stoppers further comprise on their superstructure a driving mechanism, wherein one driving mechanism is located on the internal surface of the external stopper and a second driving mechanism is located on the external surface of the threaded internal stopper, such that the external stopper, when it is subjected to an axial pressure and then a rotation, engages the threaded internal stopper and drives it, by means of interaction of the respective driving mechanisms, as required for an opening movement, f) wherein the driving mechanism on the superstructure on the internal surface of the external stopper and on the external surface of the threaded internal stopper comprise teeth placed in an annulus of the respective surfaces, and g) wherein each of the teeth on the external surface of the threaded internal stopper comprises an oblique face on one side thereof which interacts with the teeth on the internal surface of the external stopper only when both axial pressure and rotational movement are applied to the external stopper to remove the closing means from the container.

17. Child-safety closing device of claim 16, h) characterised in that the external stopper further comprises on the internal surface of the top end wall in contact with the external surface of the top end wall of the threaded internal stopper a deformable spacing elements with shape memory capable of deforming when a vertical downward pressure is exerted on the external stopper allowing engagement of these driving means, characterised in that the deformable spacing elements with shape memory comprise segments of tongues positioned in a circle, forming a splayed miniskirt secured to the internal face of the external stopper, each of the segments having the ability to fold elastically around its connection line with the internal surface of the top end wall of the external stopper when pressure is exerted on these segments.

* * * * *